US008796950B2

(12) United States Patent
Angeles

(10) Patent No.: US 8,796,950 B2
(45) Date of Patent: Aug. 5, 2014

(54) FEEDBACK CIRCUIT FOR NON-ISOLATED POWER CONVERTER

(71) Applicant: Power Integrations, Inc., San Jose, CA (US)

(72) Inventor: Christian P. Angeles, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 83 days.

(21) Appl. No.: 13/673,421

(22) Filed: Nov. 9, 2012

(65) Prior Publication Data

US 2014/0132182 A1 May 15, 2014

(51) Int. Cl.
*H05B 37/02* (2006.01)
*H05B 33/08* (2006.01)

(52) U.S. Cl.
CPC ..... *H05B 33/0851* (2013.01); *H05B 33/0815* (2013.01)
USPC ..... 315/294; 315/122

(58) Field of Classification Search
CPC ..... H05B 33/0851; H05B 33/0815
USPC ..... 315/121, 122, 193, 291, 307
See application file for complete search history.

(56) References Cited

U.S. PATENT DOCUMENTS

| | | | | |
|---|---|---|---|---|
| 6,917,504 | B2 * | 7/2005 | Nguyen et al. | 361/100 |
| 8,541,957 | B2 * | 9/2013 | Kang | 315/307 |
| 2001/0033156 | A1 * | 10/2001 | Buono | 323/282 |
| 2005/0185428 | A1 * | 8/2005 | Crawford et al. | 363/21.06 |
| 2012/0032610 | A1 * | 2/2012 | Kang | 315/297 |

* cited by examiner

*Primary Examiner* — Don Le
(74) *Attorney, Agent, or Firm* — Morrison & Foerster LLP

(57) ABSTRACT

A feedback circuit for a power converter (e.g., a non-isolated converter) is disclosed. The feedback circuit may include a sense circuit coupled to receive an output current of the converter. A sense voltage may be generated across the sense circuit and a voltage-to-current converter may be used to convert the sensed voltage into a feedback signal representative of the output current. The voltage-to-current converter may include a variable shunt regulator, resistor, and transistor. A voltage across the shunt regulator may change in response to a change in voltage across the sense circuit, and the feedback signal may change in response to a change in the voltage across the shunt regulator. A controller may be coupled to receive the feedback signal from the feedback circuit and may control switching of a power switch to regulate the output current based at least in part on the feedback signal.

22 Claims, 5 Drawing Sheets

$V_{VARIABLE} = V_{RS1} + V_{RS2} + V_{RS3} + \cdots + V_{RSN}$ $V_{MIN} = V_{D1} + V_{D2} + V_{D3} + \cdots + V_{DN}$

FEEDBACK CIRCUIT FOR NON-ISOLATED POWER CONVERTER

BACKGROUND

1. Field

The present disclosure relates generally to power converters and, more specifically, to feedback circuits for power converters.

2. Description of Related Art

Electronic devices are typically used with power conversion circuits. Switched mode power converters are commonly used due to their high efficiency, small size and low weight to power many of today's electronics. Conventional wall sockets provide a high voltage alternating current (ac). In a switched mode power converter, a high voltage ac input is converted to provide a well-regulated direct current (dc) output. In operation, a switch, included in the switched mode power converter, is utilized to control the desired output by varying the duty ratio (typically the ratio of the on time of the switch to the total switching period) and/or varying the switching frequency (the number of switching events per unit time). More specifically, a switched mode power converter controller may determine the duty ratio and/or switching frequency of the switch in response to a measured input and a measured output.

Conventional power converters include a controller that may be configured to provide a regulated voltage and/or a regulated current at the output of the power converter. In general, a regulated power converter may also be referred to as a power supply. One type of conventional controller monitors a voltage at the output of the power converter in order to provide a regulated output voltage while another type of controller monitors a current at the output in order to provide a regulated output current. One way to measure the output current is to include a sense resistor at the output of the power converter such that the output current flows through the sense resistor and the resultant voltage dropped across the sense resistor is proportional to the output current. However, the voltage dropped across the sense resistor is typically large and often referenced to a voltage level different than that of the power converter controller. Thus, additional circuitry, such as an opto-coupler or a bias winding, is often needed to level shift the voltage across the sense resistor in order to interface with the controller. However, these components can be bulky and expensive.

Additionally, for some conventional applications, the input of the power converter may be galvanically isolated from the output of the power converter. In general, galvanic isolation prevents dc current from flowing between the input and the output of the power converter Implementing galvanic isolation, however, usually requires additional circuitry, such as a magnetic coupler or an opto-coupler, which adds cost to the power converter.

DESCRIPTION OF THE FIGURES

Non-limiting and non-exhaustive embodiments of the present invention are described with reference to the following figures, wherein like reference numerals refer to like parts throughout the various views unless otherwise specified.

DETAILED DESCRIPTION

Embodiments of a power converter having a feedback circuit are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. In addition, it is appreciated that the figures provided herewith are for explanation purposes to persons ordinarily skilled in the art and that the drawings are not necessarily drawn to scale.

For embodiments of the present disclosure, a power converter controller controls switching of a switch to regulate an output current in response to the output current. In addition, a power converter, in accordance with embodiments disclosed herein, may be non-isolated and may also include a feedback circuit that directly measures the output current without the need for isolation between the output and the controller.

Figure 1:
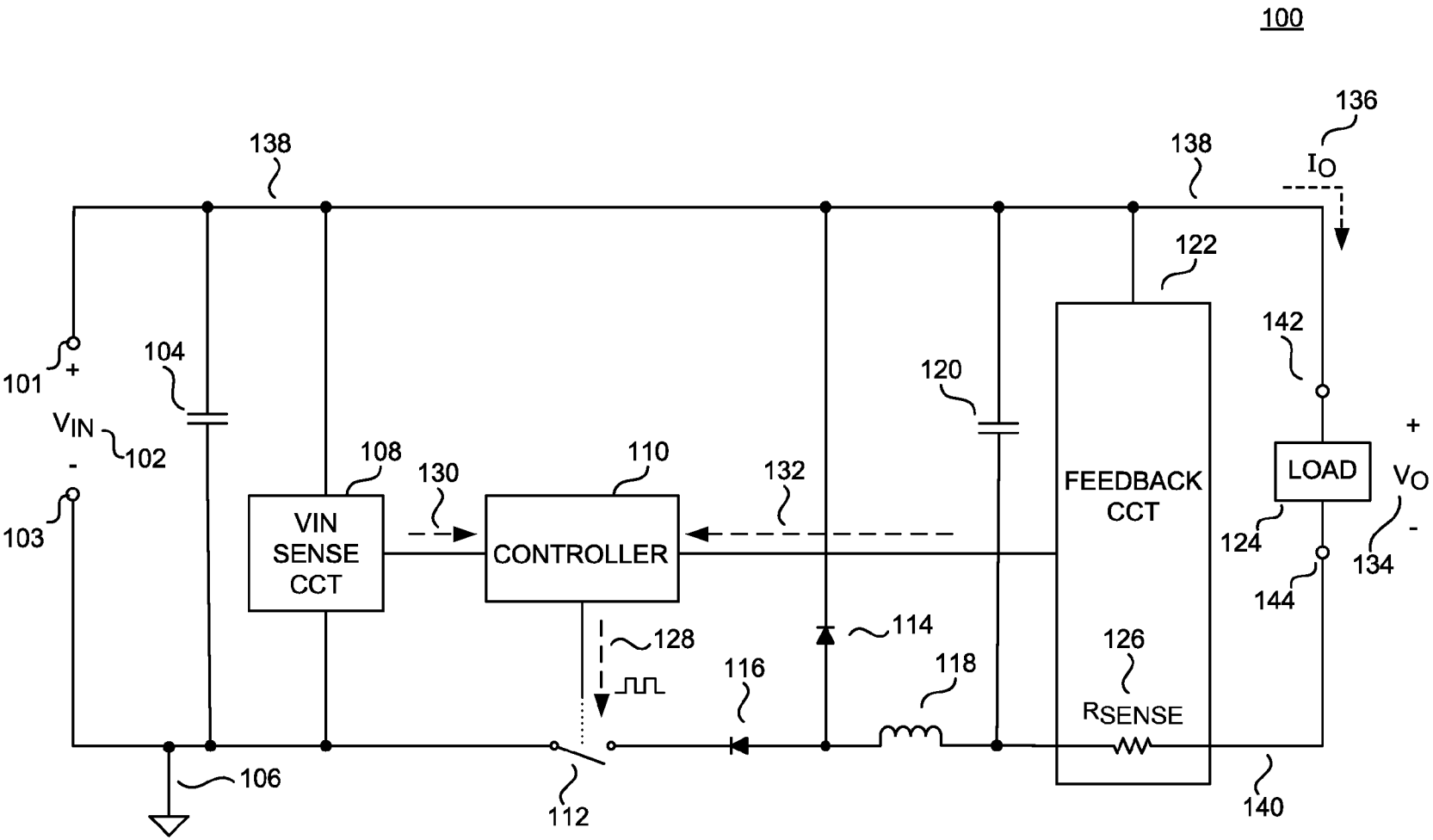
FIG. 1 is a functional block diagram illustrating an example power converter and load, in accordance with various embodiments.

FIG. 1 is a functional block diagram illustrating an example power converter 100 and a load 124. The illustrated example of power converter 100 is shown as including input terminals 101 and 103 (collectively referred to herein as the "input" of the power converter), an input capacitor 104, a positive input voltage rail 138, an input voltage sense circuit 108, a controller 110, a feedback circuit 122 having a sense circuit 126 (shown in this example as including sense resistor $R_{SENSE}$ 126), an output capacitor 120, an input return 106, a switch 112, diodes 114 and 116, an inductor 118, an output return 140, and output terminals 142 and 144 (collectively referred to herein as the "output" of the power converter). While in this example sense circuit 126 includes sense resistor 126, it should be appreciated that other current sense circuits known to those of ordinary skill in the art may be used. Also shown in FIG. 1 is an input voltage $Y_{IN}$ 102, an input voltage sense signal 130, a feedback signal 132, a drive signal 128, an output current $I_O$ 136, and an output voltage $V_O$ 134.

Power converter 100 is a non-isolated power converter. For example, in the illustrated embodiment, the input of power converter 100 is electrically coupled to the output (e.g., dc current is able to flow between input terminals 101/103 and output terminals 142/144). During operation, power converter 100 provides a regulated output voltage $V_O$ 134 and/or output current $I_O$ 136 to load 124 from an unregulated input voltage $V_{IN}$ 102. In one embodiment, the input of power converter 100 receives input voltage $V_{IN}$ 102 from a rectifier circuit (discussed below), which in turn is coupled to receive an unregulated ac input voltage from a source (not shown), such as a conventional wall socket. In another embodiment, the input of power converter 100 receives a dc input voltage from a source (not shown). As shown in FIG. 1, input terminal 101 is coupled to positive input voltage rail 138, while input terminal 103 is coupled to input return 106.

FIG. 1 further illustrates input capacitor 104 as having one terminal coupled to positive input voltage rail 138 and another terminal coupled to input return 106. As shown in FIG. 1, input capacitor 104 is coupled to receive the input voltage $V_{IN}$ 102. In one embodiment, input capacitor 104 provides a filtering function for noise, such as electro-magnetic interference (EMI) or other transients. For other applications, the input capacitor 104 may have a capacitance large enough such that a dc voltage is applied at the input of the power converter 100. However, for power converters with power factor correction (PFC), a small input capacitor 104 may be utilized to allow the voltage at the input of the power converter 100 to substantially follow the rectified ac input voltage $Y_{IN}$ 102. As such, the value of the input capacitor 104 may be chosen such that the voltage on the input capacitor 104 reaches substantially zero when the rectified ac input voltage $Y_{IN}$ 102 reaches substantially zero.

FIG. 1 further illustrates switch 112 as having one terminal coupled to input return 106 and another terminal coupled to diode 116. Diode 116 is then coupled to diode 114 and inductor 118. Diode 116 is coupled to prevent reverse current flow in switch 112. However, it should be appreciated that diode 116 may be optional. Inductor 118 is further coupled to one end of capacitor 120 and feedback circuit 122. As shown in FIG. 1, diode 114 is coupled to the positive input voltage rail 138 and inductor 118.

The terminals of capacitor 120 are shown in FIG. 1 as being coupled between positive input voltage rail 138 and inductor 118. Load 124 is shown as being coupled between output terminals 142 and 144. In operation, output capacitor 120 produces a substantially constant output current $I_O$ 136, output voltage $V_O$ 134, or a combination of the two, which is received by load 124.

During operation, load 124 may receive substantially constant power. Load 124 may also be a load where the output voltage varies as a function of the output current in a predetermined and known manner. For example, output voltage $V_O$ 134 may be substantially proportional to output current $I_O$ 136. In one embodiment, load 124 may be an LED array, as will be discussed in further detail below.

Feedback circuit 122 is coupled to sense output current $I_O$ 136 from the output of power converter 100 to produce feedback signal 132. Feedback circuit 122 is further coupled to controller 110 such that feedback signal 132 is received by controller 110. Feedback signal 132 may be a voltage signal or a current signal that is representative of output current $I_O$ 136. It is recognized that a voltage signal and current signal each may contain both a voltage component and a current component. However, the term "voltage signal" as used herein means that the voltage component of the signal is representative of the relevant information. Similarly, the term "current signal" as used herein means that the current component of the signal is representative of the relevant information. By way of example, feedback signal 132 may be a current signal having a voltage component and a current component, where it is the current component that is representative of output current $I_O$ 136.

As shown in FIG. 1, input voltage sense circuit 108 is coupled to sense the input voltage $V_{IN}$ 102. In one embodiment, input voltage sense circuit 108 detects the peak voltage of input voltage $Y_{IN}$ 102. Input voltage sense circuit 108 is also coupled to generate input voltage sense signal 130, which may be representative of the peak voltage of input voltage $Y_{IN}$ 102. In another example, input voltage sense signal 130 may be representative of the average voltage of input voltage $Y_{IN}$ 102. Input voltage sense signal 130 may be a voltage signal or a current signal that is representative of input voltage $Y_{IN}$ 102.

Controller 110 is coupled to generate a drive signal 128 to control the switching of switch 112. Controller 110 may be implemented as a monolithic integrated circuit or may be implemented with discrete electrical components or a combination of discrete and integrated components. In addition, switch 112 receives the drive signal 128 from the controller 110.

Switch 112 is opened and closed in response to drive signal 128. It is generally understood that a switch that is closed may conduct current and is considered on, while a switch that is open cannot substantially conduct current and is considered off. In one embodiment, switch 112 may be a transistor, such as a metal-oxide-semiconductor field-effect transistor (MOSFET). In one example, controller 110 and switch 112 form part of an integrated control circuit that is manufactured as either a hybrid or monolithic integrated circuit.

As shown in FIG. 1, controller 110 outputs drive signal 128 to control the switching of switch 112 in response to feedback signal 132 and in response to input voltage sense signal 130. In one embodiment, the drive signal 128 is a pulse width modulated (PWM) signal of logic high and logic low sections, with the logic high value corresponding to a closed switch and a logic low corresponding to an open switch. In another embodiment, drive signal 128 is comprised of substantially fixed-length logic high (or ON) pulses and regulates the output (shown as output current $I_O$ 136, output voltage $V_O$ 134, or a combination of the two) by varying the number of ON pulses over a set time period.

In operation, drive signal 128 may have various drive signal operating conditions, such as the switch on-time $t_{ON}$ (typically corresponding to a logic high value of the drive signal 128), switch off-time $t_{OFF}$ (typically corresponding to a logic low value of the drive signal 128), switching frequency $f_s$, or duty ratio. As mentioned above, load 124 can be a constant load. Thus, during operation, controller 110 may utilize feedback signal 132 and input voltage sense signal 130 to regulate the output (e.g., output current $I_O$ 136). For example, a reduction in the input voltage sense signal 130 may correspond to the input voltage sense circuit 108 sensing a lower value of the input voltage $Y_{IN}$ 102. Thus, controller 110 may extend the duty ratio of drive signal 128 to maintain a constant output current $I_O$ 136 in response to this reduction in the input voltage sense signal 130.

In one example, controller 110 may perform PFC, where a switch current (not shown) through switch 112 is controlled to change proportionately with the input voltage $Y_{IN}$ 102. By way of example, controller 110 may perform PFC by controlling the switching of switch 112 to have a substantially constant duty ratio for a half line cycle of the ac input voltage (not shown). In general, the ac input voltage (not shown) is a sinusoidal waveform and the period of the ac input voltage is referred to as a full line cycle. As such, half the period of the ac input voltage is referred to as a half line cycle. In another example, the controller 110 may perform PFC by sensing the switch current and comparing the integral of the switch current to a decreasing linear ramp signal.

Figure 2B:
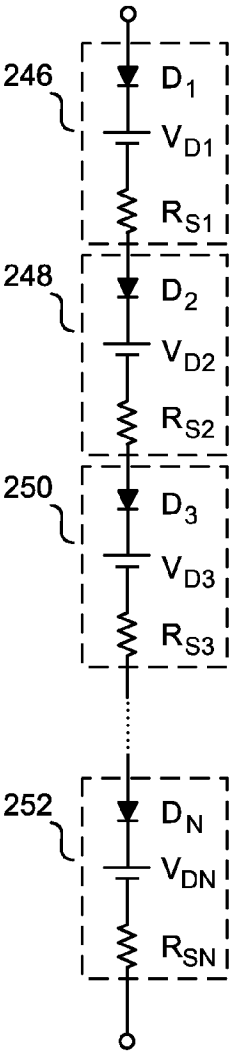
FIG. 2B is a diagram illustrating a circuit model of LEDs included in the LED array of FIG. 2A.
Figure 2A:
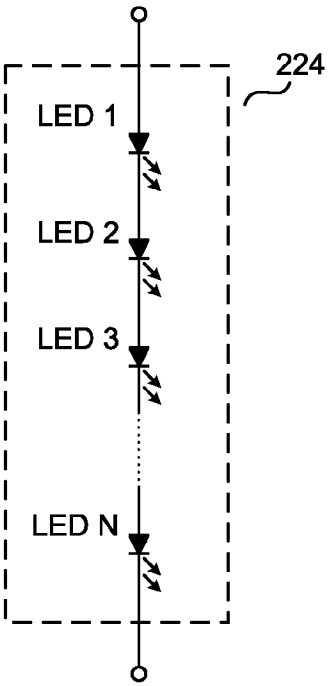
FIG. 2A is a diagram illustrating a light-emitting diode (LED) array, in accordance with various embodiments.
Figure 2C:
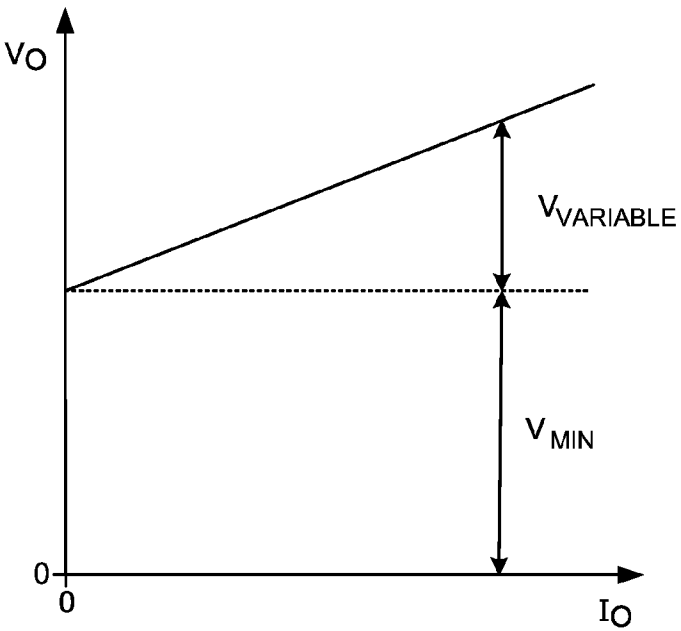
FIG. 2C is a graph illustrating a relationship between output current and output voltage of the circuit model of LEDs of FIG. 2B.

As discussed above, load 124 may be a substantially constant load that does not vary during operation of the power converter. FIG. 2A illustrates an LED array 224, which is one possible implementation of load 124 of FIG. 1. As shown, LED array 224 includes N number of LEDs (i.e., LED 1 though LED N). As further shown, FIG. 2B is a diagram illustrating a circuit model of the LEDs included in the LED array 224 of FIG. 2A. LEDs 246, 248, 250, and 252 are circuit models of LEDs 1, 2, 3, and N, respectively, of FIG. 2A. That is, LED 1 may be represented by the model LED 246, which includes an ideal diode $D_1$, a threshold voltage $V_{D1}$ and a series resistance $R_{S1}$. Thus, LED 246 will generally conduct current when the voltage across LED 246 exceeds threshold voltage $V_{D1}$ and the current through LED 246 will be proportional to the voltage across it due in part to series resistance $R_{S1}$. FIG. 2C is a graph illustrating a relationship between output current and output voltage of the circuit model of LEDs of FIG. 2B. As shown in FIG. 2C, the sum of the threshold voltages $V_{D1}$ through $V_{DN}$ represents a minimum voltage $V_{MIN}$ necessary to turn on the LEDs. That is, LED array 224 will generally not conduct current until the output voltage $V_O$ exceeds the minimum voltage $V_{MIN}$. Also, shown in FIG. 2C is that for output voltages $V_O$ greater than the minimum voltage $V_{MIN}$, the output current $I_O$ is generally proportional to the output voltage $V_O$. In other words, as the output current $I_O$ is reduced through LED array 224, a proportional reduction in voltage across the series resistance $R_{S1}$, $R_{S2}$, . . . $R_{SN}$ occurs as well, thus, reducing the overall output voltage $V_O$.

In the examples where load 124 includes an LED array similar or identical to array 224, it can be desirable to have a well-regulated output current $I_O$ 136 to generate a uniform brightness. If the output current $I_O$ 136 (or output voltage) is not properly regulated, a flickering effect can be produced by the LED array 224.

Figure 3:
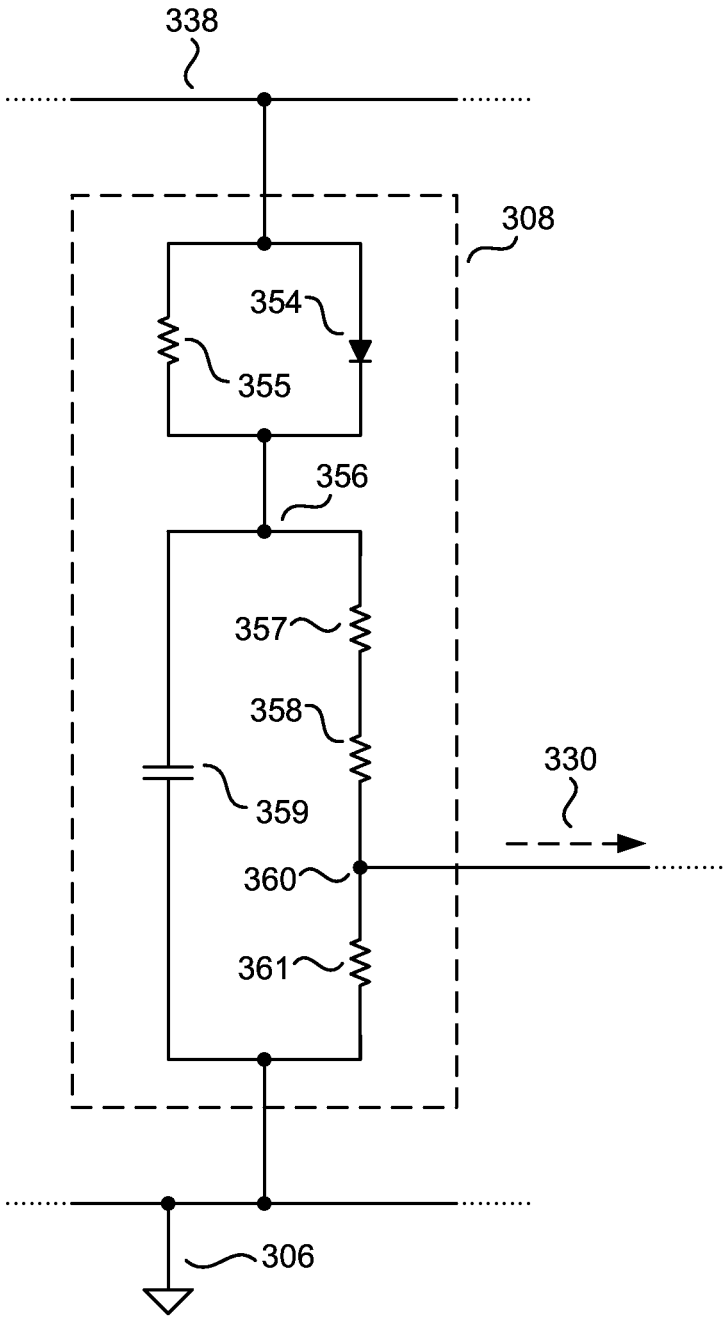
FIG. 3 is a circuit diagram of an example input voltage sense circuit, in accordance with various embodiments.

FIG. 3 is a circuit diagram of an example input voltage sense circuit 308, in accordance with an embodiment of the present disclosure. Input voltage sense circuit 308 is one possible implementation of input voltage sense circuit 108 of FIG. 1. The illustrated example of input voltage sense circuit 308 includes a diode 354, resistors 355, 357, 358, and 361, a capacitor 359, and nodes 356 and 360. Also shown in FIG. 3 are positive input voltage rail 338 (e.g., positive input voltage rail 138), input return 306 (e.g., input return 106), and input voltage sense signal 330 (e.g., input voltage sense signal 130).

In one embodiment, input voltage sense circuit 308 detects the peak voltage of input voltage $V_{IN}$ 102. Input voltage sense circuit 308 is also coupled to generate input voltage sense signal 330, which may be representative of the peak voltage of input voltage $V_{IN}$ 102. Input voltage sense signal 330 may be a voltage signal or a current signal and is representative of input voltage $V_{IN}$ 102.

During operation, the voltage between nodes 356 and 360 may be relatively high. Thus, the illustrated example of input voltage sense circuit 308 includes resistors 357 and 358 coupled in series between nodes 356 and 360 such that the voltage rating of each resistor is not exceeded during operation. Although, FIG. 3 illustrates two resistors (i.e., resistors 357 and 358) as coupled between nodes 356 and 360, any number of resistors, including one or more, may be utilized such that the voltage rating of each resistor is not exceeded.

Figure 4:
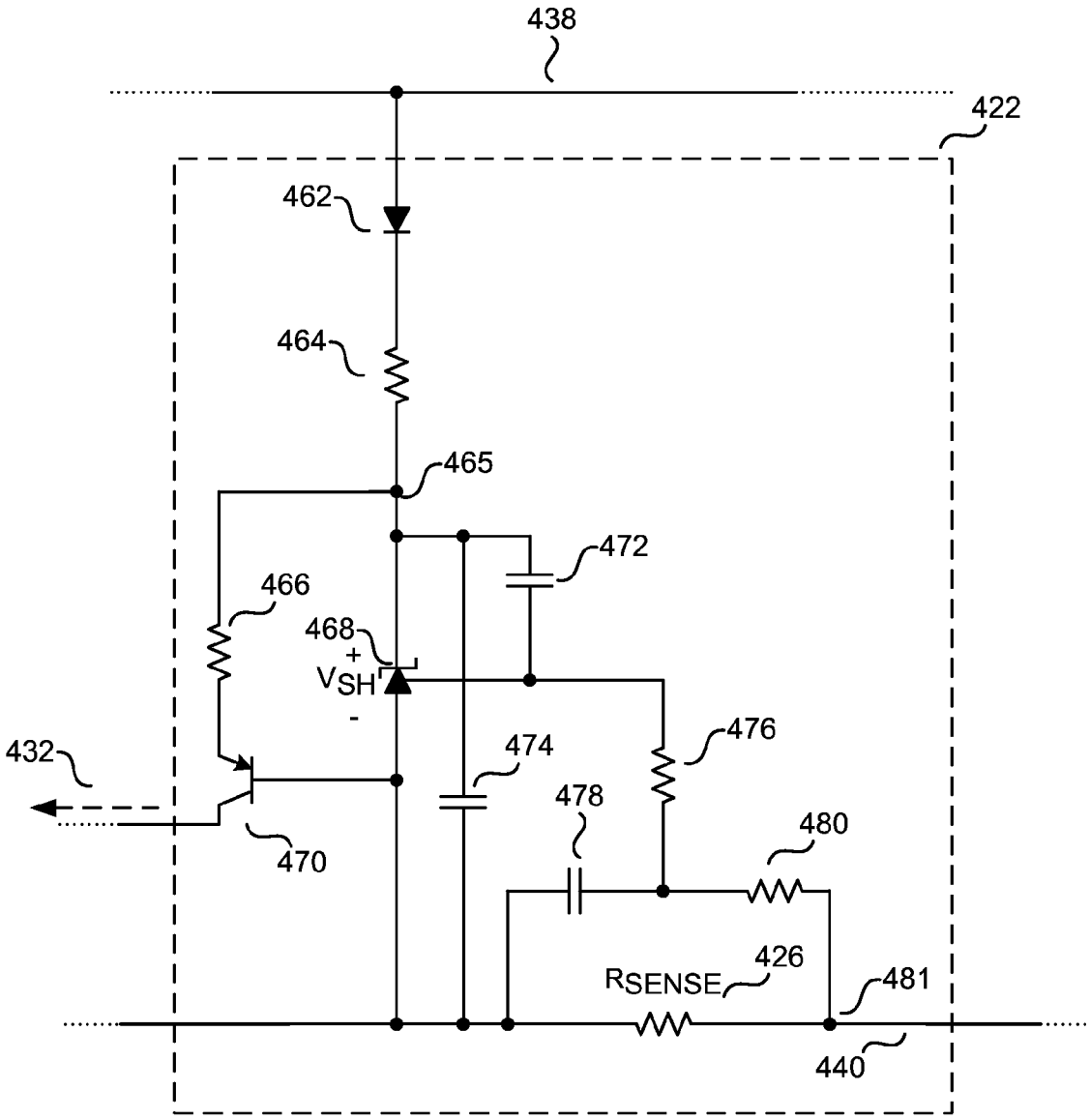
FIG. 4 is a circuit diagram of an example feedback circuit, in accordance with various embodiments.

FIG. 4 is a circuit diagram of an example feedback circuit 422, in accordance with various embodiments. Feedback circuit 422 is one possible implementation of feedback circuit 122 of FIG. 1. Feedback circuit 422 may generate feedback signal 432 (e.g., feedback signal 132) that is representative of the output current $I_O$ 136. Although feedback signal 432 that is generated by feedback circuit 422 is a current signal, it is recognized that feedback circuit 422 may include additional circuitry (not shown) to generate feedback signal 432 as a voltage signal and still be in accordance with the teachings disclosed herein.

Feedback circuit 422 includes diode 462 between positive input voltage rail 438 (e.g., positive input voltage rail 138) and resistor 464. More specifically, the anode of diode 462 may be coupled to positive input voltage rail 438 and the cathode of diode 462 may be coupled to one end of resistor 464. Resistor 464 may be further coupled to node 465. Further shown as included in feedback circuit 422 is a capacitor 474 coupled between node 465 and one end of sense circuit 426. In the example illustrated, sense circuit 426 includes sense resistor $R_{SENSE}$ 426. However, it should be appreciated that other known current sense circuits may be used.

Feedback circuit 422 is shown as further including capacitor 472 coupled to node 465, shunt regulator 468, and resistor 476. Further, one end of capacitor 472 is coupled to the cathode of the shunt regulator 468 while the other end of capacitor 472 is coupled to the reference of the shunt regulator 468. One end of resistor 476 is also coupled to the reference of the shunt regulator 468 while the other end of resistor 476 is coupled to capacitor 478 and resistor 480. Resistor 480 is coupled to output return 440 and sense circuit 426. Capacitor 478 is further coupled to the opposite terminal of sense circuit 426.

As mentioned above, feedback circuit 422 may further include shunt regulator 468. In the example illustrated, the cathode of shunt regulator 468 is coupled to node 465, while the anode of shunt regulator 468 is coupled to transistor 470.

Feedback circuit 422 may further include a voltage-to-current converter that includes resistor 466, transistor 470, and shunt regulator 468. Resistor 466 may be coupled to node 465 and the emitter of transistor 470. Transistor 470 may include a PNP bipolar junction transistor coupled to operate in the linear region of the transistor. Transistor 470 may have its base coupled to shunt regulator 468 and may be coupled to output feedback signal 432. As discussed above, feedback signal 432 may be a current signal that is representative of output current $I_O$ 136. In one embodiment, feedback signal 432 is at least substantially proportional to the output current $I_O$ 136.

In operation, an output current $I_O$ 136 flows from load 124 to node 481, causing a sense voltage to be generated across the sense circuit 426 (shown in this example as including sense resistor $R_{SENSE}$ 426). The sense voltage is proportional to the output current $I_O$ 136. This sense voltage is filtered by resistor 480 and capacitor 478. The sense voltage also causes a voltage $V_{SH}$ to be formed across shunt regulator 468. Voltage $V_{SH}$ may be filtered by capacitor 474 and resistor 464 allows the voltage at node 465 to vary. The voltage across resistor 466 is proportional to the voltage $V_{SH}$ across the cathode and anode of the shunt regulator 468. For example, the voltage across resistor 466 is substantially equal to voltage $V_{SH}$ minus the emitter-base $V_{EB}$ voltage of transistor 470 (e.g., approximately 0.7 V). The current entering the emitter of transistor 470 is substantially equal to the current across resistor 466. In the example shown, the emitter current is substantially equal to the voltage across resistor 466 divided by the resistance of resistor 466. For a transistor 470 with a large beta value, the collector current (i.e., feedback signal 432) is substantially equal to the emitter current. In the example shown, the emitter current is substantially equal to $(V_{SH}-V_{EB})$/(resistance of resistor 466). Voltage $V_{SH}$ across shunt regulator 468 decreases as the output current increases. As such, the feedback signal 432 also decreases with increasing output current. Similarly, voltage $V_{SH}$ across shunt regulator 468 increases as the output current decreases. As such, the feedback signal 432 also increases with decreasing output current.

In the illustrated example, the value of the various components may be selected to set the value of feedback signal 432 such that feedback signal 432 is within an operating range of the controller (e.g., controller 110).

Accordingly, embodiments of the present disclosure provide for a feedback circuit, such as feedback circuit 422, that provides a feedback signal that is representative of the output current $I_O$ 136 of the power converter without the need for additional isolation circuitry, as discussed above with conventional systems. As shown in FIGS. 1 and 4, the output of power converter 100 may not be electrically isolated from controller 110 by way of feedback circuit 122 or 422.

Figure 5:
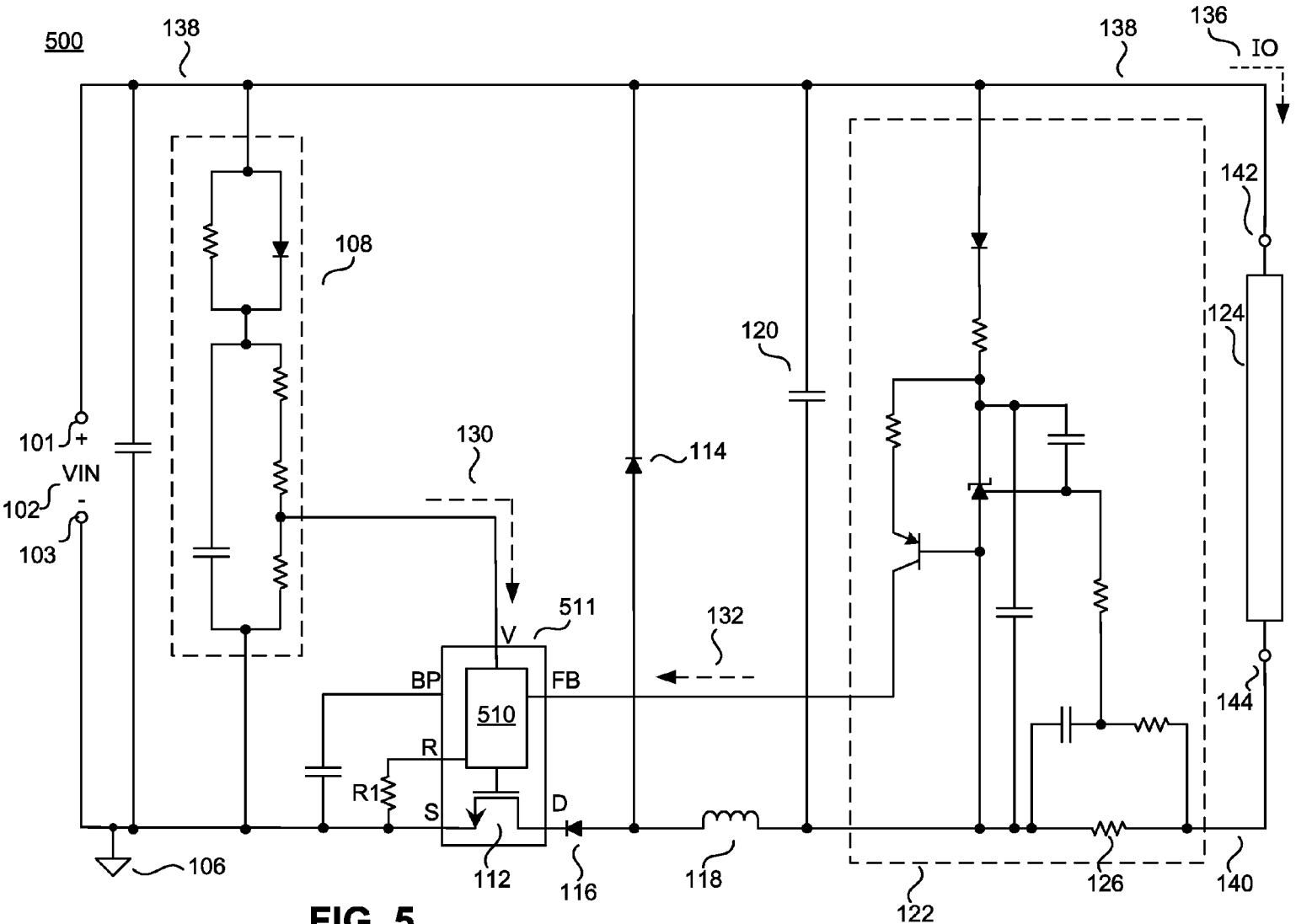
FIG. 5 is a circuit diagram of an example power converter, rectifier circuit, and load, in accordance with various embodiments.

FIG. 5 is a circuit diagram of an example power converter 500 having a feedback circuit similar or identical to that shown in FIG. 4 and an input voltage sense circuit similar or identical to that shown in FIG. 3. Power converter 500 is one possible implementation of power converter 100 of FIG. 1. In one embodiment, load 124 may include an LED array, such as LED array 224 of FIG. 2A, and power converter 500, a rectifier circuit (not shown), and the LED array may be packaged together into a single apparatus, such as an LED lamp (e.g., an LED light bulb). The LED lamp including power converter 500, rectifier, and LED array 224 may be designed to be interchangeable with, and serve as a replacement for, conventional incandescent or compact fluorescent light bulbs.

AC input terminals 101 and 103 may be coupled to receive a rectified ac input voltage $V_{IN}$ 102 from a rectifier circuit (not shown). The rectifier circuit may include a full-wave bridge rectifier operable to receive an unregulated ac input voltage from a power source, such as a conventional wall socket, and output the rectified input voltage $V_{IN}$ 102.

As shown in FIG. 5, integrated control circuit 511 is a low-side controller. That is, the switch 112 is coupled to the input return 106. For the example shown, integrated control circuit 511 has a source terminal S that is coupled to input return 106. Integrated control circuit 511 is shown in FIG. 5 as including other terminals in addition to the source terminal S (i.e., bypass terminal BP, reference terminal R, input voltage terminal V, feedback terminal FB, and drain terminal D, etc.). As shown in FIG. 5, input voltage terminal V is coupled to receive input voltage sense signal 130. As mentioned above, input voltage sense signal 130 may be a current signal. Thus, input voltage terminal V may be configured to sink the current received from input voltage sense circuit 108. Further shown in FIG. 5 is feedback terminal FB coupled to receive feedback signal 132. As also mentioned above, feedback signal 132 may be a current signal and thus, feedback terminal FB may be configured to sink the current received from feedback circuit 122. In one example, reference terminal R is coupled to source terminal S through resistor R1 to provide controller 510 with a reference with which to compare the other signals received by the controller. In one embodiment, the feedback signal 132 and input voltage sense signal 130 may both be referenced with respect to the source terminal S.

Although FIG. 5 illustrates switch 112 as including a MOSFET, switch 112 may also be a power switching device including a bipolar transistor or an insulated gate bipolar transistor (IGBT).

The above description of illustrated examples of the present invention, including what is described in the Abstract, are not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

These modifications can be made to examples of the invention in light of the above detailed description. The terms used in the following claims should not be construed to limit the invention to the specific embodiments disclosed in the specification and the claims. Rather, the scope is to be determined entirely by the following claims, which are to be construed in accordance with established doctrines of claim interpretation. The present specification and figures are accordingly to be regarded as illustrative rather than restrictive.

What is claimed is:

1. A feedback circuit for a power converter, the feedback circuit comprising:

a sense circuit coupled to receive an output current of a power converter; and a voltage-to-current converter operable to output a feedback signal representative of the output current of the power converter, the voltage-to-current converter comprising a shunt regulator coupled to the sense circuit, wherein a voltage across the shunt regulator changes in response to a change in a voltage across the sense circuit, and wherein the feedback signal changes in response to a change in the voltage across the shunt regulator.

2. The feedback circuit of claim 1, wherein:

the voltage-to-current converter further comprises a resistor and a transistor;

a base of the transistor is coupled to the shunt regulator;

the resistor is coupled between an emitter of the transistor and the shunt regulator; and the transistor is configured to output the feedback signal.

3. The feedback circuit of claim 2, wherein the transistor comprises a PNP bipolar junction transistor.

4. The feedback circuit of claim 1, further comprising:

a diode coupled to an output of the power converter; and a resistor coupled between the diode and the shunt regulator.

5. The feedback circuit of claim 1, further comprising filter circuitry coupled across the sense circuit, wherein the filter circuitry comprises a first capacitor and a first resistor.

6. The feedback circuit of claim 5, further comprising:

a second resistor coupled to the first capacitor and first resistor; and a second capacitor coupled between the second resistor and the shunt regulator.

7. The feedback circuit of claim 1, further comprising a capacitor coupled across the shunt regulator.

8. The feedback circuit of claim 1, wherein the feedback signal increases as the output current decreases.

9. The feedback circuit of claim 1, wherein the feedback signal decreases as the output current increases.

10. The feedback circuit of claim 1, wherein the feedback circuit is coupled to output the feedback signal to a controller of the power converter.

11. The feedback circuit of claim 1, wherein the power converter is a non-isolated power converter.

12. A power converter, comprising:

a feedback circuit comprising:

a sense circuit coupled to receive an output current of a power converter; and a voltage-to-current converter operable to output a feedback signal representative of the output current of the power converter, the voltage-to-current converter comprising a shunt regulator coupled to the sense circuit, wherein a voltage across the shunt regulator changes in response to a change in a voltage across the sense circuit, and wherein the feedback signal changes in response to a change in the voltage across the shunt regulator; and a controller coupled to receive the feedback signal from the feedback circuitry, wherein the controller is operable to control the output current based at least in part on the feedback signal.

13. The power converter of claim 12, wherein the power converter is a non-isolated power converter.

14. The power converter of claim 12, wherein:

the voltage-to-current converter further comprises a resistor and a transistor;

a base of the transistor is coupled to the shunt regulator;

the resistor is coupled between an emitter of the transistor and the shunt regulator; and the transistor is configured to output the feedback signal.

15. The power converter of claim 12, wherein the feedback signal increases as the output current decreases.

16. The power converter of claim 12, wherein the feedback signal decreases as the output current increases.

17. The power converter of claim 12, wherein the power converter is coupled to output the output current to one or more light-emitting diodes.

18. An apparatus, comprising:

a light-emitting diode; and a power converter coupled to the light-emitting diode to provide an output current to the light-emitting diode, wherein the power converter comprises:

a feedback circuit comprising:

a sense circuit coupled to receive an output current of a power converter; and a voltage-to-current converter operable to output a feedback signal representative of the output current of the power converter, the voltage-to-current converter comprising a shunt regulator coupled to the sense circuit, wherein a voltage across the shunt regulator changes in response to a change in a voltage across the sense circuit, and wherein the feedback signal changes in response to a change in the voltage across the shunt regulator; and a controller coupled to receive the feedback signal from the feedback circuitry, wherein the controller is operable to control the output current based at least in part on the feedback signal.

19. The apparatus of claim 18, wherein the power converter is a non-isolated power converter.

20. The apparatus of claim 18, wherein:

the voltage-to-current converter further comprises a resistor and a transistor;

a base of the transistor is coupled to the shunt regulator;

the resistor is coupled between an emitter of the transistor and the shunt regulator; and the transistor is configured to output the feedback signal.

21. The apparatus of claim 18, wherein the feedback signal increases as the output current decreases.

22. The apparatus of claim 18, wherein the feedback signal decreases as the output current increases.

* * * * *